US005582689A

United States Patent [19]

Van Haag et al.

[11] Patent Number: 5,582,689

[45] Date of Patent: Dec. 10, 1996

[54] PRESSING APPARATUS HAVING A CONCAVE PRESSURE SHOE WITH VARIABLE RADIUS OF CURVATURE

[75] Inventors: Rolf Van Haag, Kerken; Hans-Rolf Conard, Dormagen, both of Germany

[73] Assignee: Voith Sulzer Finishing GmbH, Krefeld, German Dem. Rep.

[21] Appl. No.: 404,644

[22] Filed: Mar. 15, 1995

[30] Foreign Application Priority Data

Mar. 24, 1994 [DE] Germany ..... 44 10 129.5

[51] Int. Cl.[6] ..... D21F 3/06; D21G 1/00

[52] U.S. Cl. ..... 162/358.5; 100/93 RP; 100/153; 167/358.3; 167/361

[58] Field of Search ..... 162/358.3, 358.4, 162/358.5, 361; 100/153, 154, 93 RP

[56] References Cited

U.S. PATENT DOCUMENTS

| | | | |
|---|---|---|---|
| 4,917,768 | 4/1990 | Ilmannen | 162/358.3 |
| 5,043,046 | 8/1991 | Laapotti | 162/358.3 |
| 5,167,768 | 12/1992 | Cronin et al. | 162/205 |
| 5,441,604 | 8/1995 | Sandberg | 162/358.3 |

FOREIGN PATENT DOCUMENTS

| | | | |
|---|---|---|---|
| 0345500 | 12/1989 | European Pat. Off. . | |
| 218918 | 2/1985 | German Dem. Rep. | 162/358.3 |
| 3920204 | 4/1991 | Germany . | |
| 3705241 | 1/1992 | Germany . | |
| 2199398 | 7/1988 | United Kingdom . | |
| 2239268 | 6/1991 | United Kingdom . | |
| 93/23613 | 11/1993 | WIPO . | |
| 93/23614 | 11/1993 | WIPO | 162/358.3 |

*Primary Examiner*—Karen M. Hastings
*Attorney, Agent, or Firm*—Darby & Darby, P.C.

[57] ABSTRACT

A pressing apparatus for web-shaped material, especially for smoothing a paper web, has a pressure gap between a roller and a concave pressure shoe. The pressure shoe is loaded by at least two loading elements, which are displaced in the circumferential direction of the roller, and whose loading forces can be adjusted individually. In this way, any desired pressure-stress profile can be set over the width of the pressure gap. Additionally, the radius of curvature of the concave pressure shoe is variable as a function of the loading forces.

6 Claims, 1 Drawing Sheet

PRESSING APPARATUS HAVING A CONCAVE PRESSURE SHOE WITH VARIABLE RADIUS OF CURVATURE

FIELD OF THE INVENTION

This invention relates generally to a pressing apparatus for web-shaped material, and more particularly, to a pressing apparatus for smoothing a paper web with a pressure formed between a preferably heatable roller and a pressure shoe, which may be covered by a circumferential band, wherein the pressure shoe has a concave pressure surface matched to the curvature of the roller surface and can be pressed against the roller by means of a loading apparatus.

BACKGROUND OF THE INVENTION

Pressing apparatuses are known, such as DE 39 20 204 C2, which discloses a pressure shoe loaded by a loading apparatus acting on its center. The loading apparatus is designed as a pressure transducer in the form of a hydraulic piston-cylinder unit. With such a pressing apparatus, the width of the pressure gap is larger than when two rollers interact. The time during which the web is retained in the pressure gap is thus extended. This yields advantages, especially when smoothing a paper web.

The number of ways in which to influence the web-shaped material is small with conventional pressing apparatuses. Besides varying the roller temperature and speed of the web, only the loading force, and thus the pressure stress in the pressure gap, can be varied.

SUMMARY OF THE INVENTION

Accordingly, it is an object of the present invention to provide a pressing apparatus which affords additional ways to vary the pressure effect, and thus improves the desired properties of the web treated.

According to the invention, this is achieved by providing a loading apparatus which has at least two loading elements displaced along the circumference of the roller, each of whose loading forces can be adjusted individually.

If the loading forces are set to the same value, a constant pressure stress is produced over the width of the pressure gap. But if the loading forces are set differently, a variable pressure stress is produced over the width of the pressure gap. In particular, despite a uniform line load, whose maximum value is determined by the design of the roller, pressure stresses of various magnitudes can be created. Either all the load elements can operate with a relatively low loading force, as determined by the width of the pressure gap, or one loading element can operate with a greater loading force, while all the other loading elements are operated with a reduced loading force. While the line load remains the same, the pressure stress can be continuously varied between these two extreme positions. This creates the capability of purposefully influencing certain parameters of the web-like material, for example, the thickness, sheen, or smoothness of the paper.

The loading elements are preferably designed as piston-cylinder units. Pressure means can be conducted to their pressure chambers at different pressures. These loading elements can be easily controlled and adapted to various circumstances by means of pressure-control valves.

Furthermore, it is advantageous if the pressure surface has at least two pockets, displaced in the circumferential direction of the roller and covered by the band. Each of these pockets is connected by a throttle duct to the pressure chamber of different pressure transducers. The movable band is positioned over the pressure surface essentially without friction and is loaded over a wide area by the pressure means.

In an alternate embodiment, there are two loading elements displaced in the circumferential direction and disposed symmetrically with respect to the center plane of the pressure shoe. As a general rule, two loading elements are sufficient to meet typical practical requirements.

It is also advantageous that the radius of curvature of the concave pressure surface, in the unloaded state, is somewhat larger than the sum of the roller radius, web thickness, and band thickness, and can be reduced as a function of the loading forces. With this design, the width of the pressure gap increases as the loading forces increase because the pressure surface adapts itself to the roller surface. Thus, both the profile of the pressure stress and the gap width can be influenced.

It is here advantageous that the larger radius of curvature is provided over only a portion of the pressure surface. For example, if the larger radius of curvature is assigned to the second half, the pressure stress can be varied by means of the loading force in the first half, and the width of the pressure gap can be varied by means of the loading force in the second half.

DETAILED DESCRIPTION OF THE INVENTION

Figure 1:
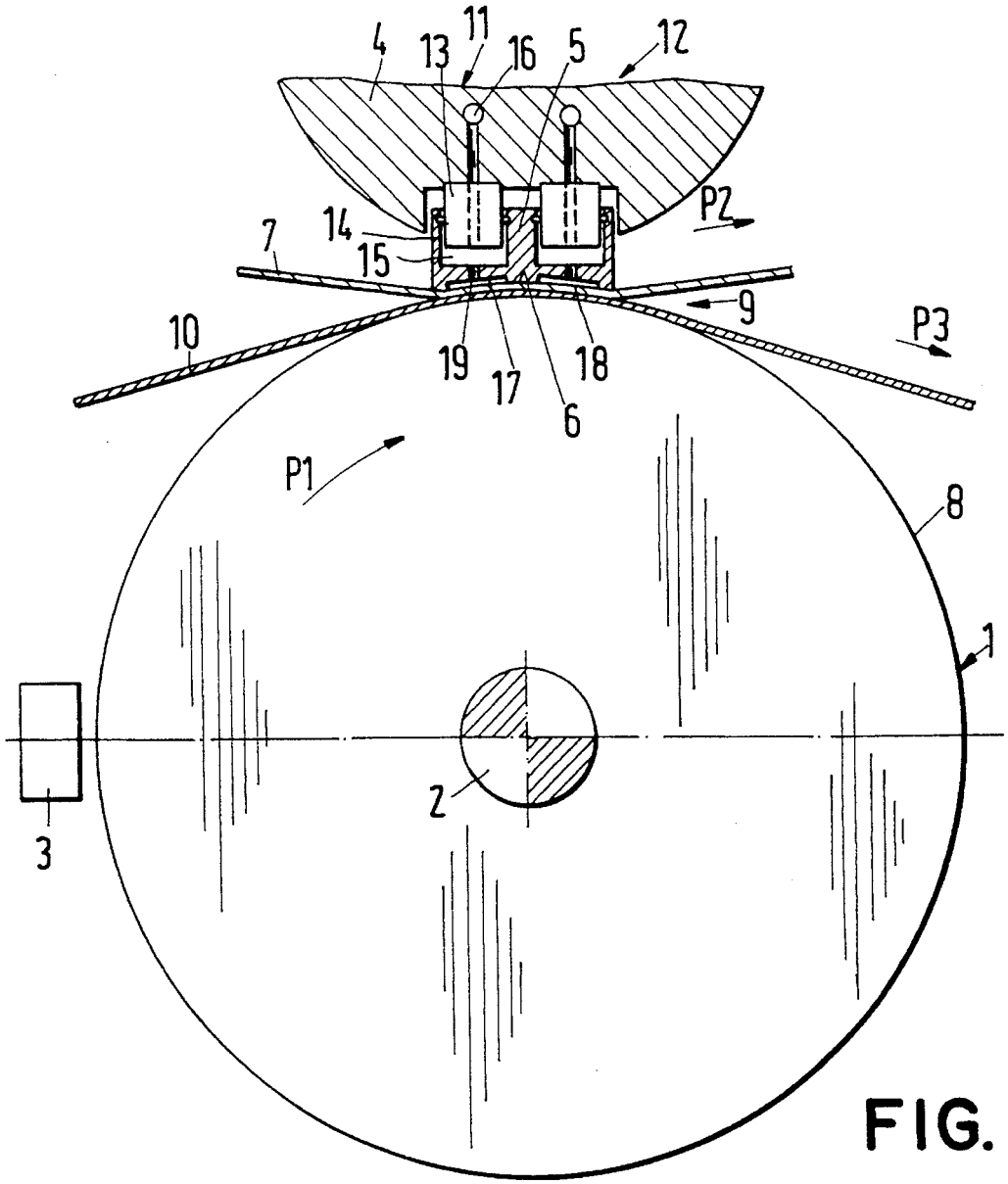
FIG. 1 is a schematic view of the preferred pressing apparatus according to the present invention.

Referring to FIG. 1, the preferred pressing apparatus has a roller 1, which has a drive 2, and which can be heated by means of an induction heater 3. A pressure shoe 5 is supported against a carder 4 for engagement with the roller 1. Instead of one pressure shoe, several pressure shoes, disposed one after the other in the longitudinal direction of the roller, can also be provided. The pressure shoe 5 has a concave pressure surface 6, which is covered by a movable elastic band 7, whose speed is preferably the same as the circumferential speed of the roller 1 or the speed of a web 10. A pressure gap 9 is situated between the pressure surface 6 and a surface 8 of the roller 1. The web 10, especially a paper web, is treated in the gap 9 by pressure and temperature. The arrows P1, P2, and P3 specify the direction of motion of the roller surface 8, the band 7, and the web 10, respectively.

The pressure shoe 5 has two loading elements 11 and 12, disposed symmetrically with respect to the center plane. As pressure transducers, each of these is equipped with a piston 13, a cylinder 14, a pressure chamber 15, and a feed line 16 for the pressure means. The pressure surface 6 has two pockets 17 and 18, which are displaced in the circumferential direction of the roller. Each of these is connected by a throttle duct 19 to the pressure chamber 15 of its associated loading element. The pockets 17 and 18 are covered by the elastic band 7, so that the band 7 is hydrostatically loaded.

The radius of curvature of the pressure surface 6 is equal to the sum of the radius of the roller 1, the thickness of the paper web 10 and the thickness of the band 7. If the same pressure is applied to the two loading elements 11 and 12, approximately the same pressure stress will result over the entire width of the pressure surface 6. However, if a higher pressure is applied to the loading element 11 than to the loading element 12, a graded pressure profile arises in the pressure gap 9. The pressures that can be applied to the loading elements 11 and 12 can be freely chosen based on the pressure profile in the pressure gap 9. However, the maximum allowable line load of the roller 1 cannot be exceeded.

Figure 2:
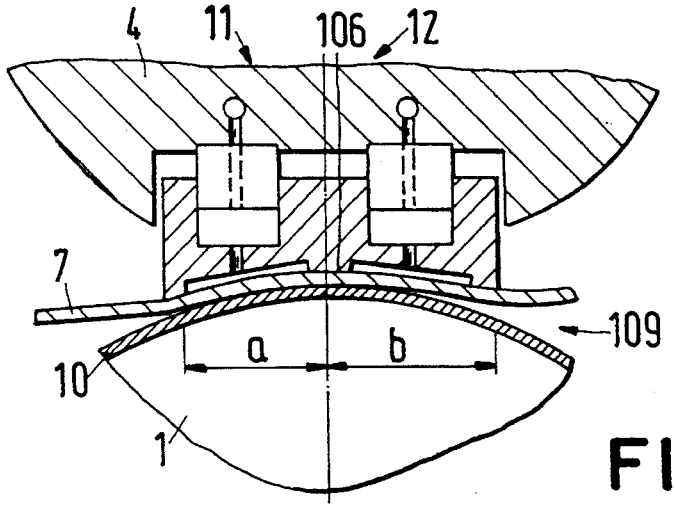
FIG. 2 is a schematic view of an alternate pressing apparatus according to the present invention.

Referring to FIG. 2, the same reference symbols as in FIG. 1 are used for the same parts, with the reference symbols increased by 100 for modified parts. The essential difference between FIG. 1 and FIG. 2 is that the first half "a" of the pressure surface 106 has a radius which is equal to the sum of the radius of the roller 1, the thickness of the web 10, and the thickness of the band 7, while the radius of the second half "b" is somewhat larger than the first half "a". The result of this size differential is that, in the unloaded state, the effective width of the pressure gap 109 is limited to the first half "a". The loading force exerted by the loading element 11 is converted into a corresponding pressure stress in the first half "a". When the loading force in the loading element 12 increases, the second half "b" of the pressure surface 106 gradually deforms to the roller surface 8, so that the width of the effective pressure gap 109 becomes larger and larger with the increase of the loading force in the loading element 12. At the same time, increasing pressures act in the pressure gap 109 so that not only the width of the gap 109 but also the pressure-stress profile, changes. In particular, the magnitude of the pressure stress can be influenced by loading means of the first loading element 11 while the width of the pressure gap 109 can be influenced by loading means of the second loading element 12.

The embodiments shown here can be modified in many respects without deviating from the spirit of the invention. In particular, more than two loading elements can be disposed, one after another, in the circumferential direction. The loading elements can also be disposed, one after another, in the direction of the roller axis, so as to also create a bending equalization. It is also possible to design the roller 1 as a bending-equalization roller, such that a roller sleeve is supported by support elements, on a non-rotatable carrier.

What is claimed is:

1. A pressing apparatus for web-shaped material, comprising:

a pressure gap formed between a roller and a single integral pressure shoe, which is covered by a circumferential band, means for heating said roller, said pressure shoe having a concave pressure surface matched to the curvature of the surface of said roller such that said pressure shoe can be pressed against said roller by means of a loading apparatus, wherein said loading apparatus has at least two loading elements displaced along the circumference of said roller, each of said at least two loading elements structured and arranged for producing individually adjustable loading forces to said single pressure shoe, wherein the radius of curvature of at least a portion of said concave pressure surface, in the unloaded state, is larger than the sum of the radius of said roller, the thickness of said web-shaped material, and the thickness of said band, and wherein said pressure shoe and said at least two loading elements are structured and arranged so that said radius of curvature of said at least a portion of said concave pressure surface is variable as a function of the loading forces.

2. The pressing apparatus of claim 1, wherein each of said at least two loading elements comprises a piston-cylinder unit having a pressure chamber, each of said at least two loading elements having means for applying pressure to said respective pressure chamber such that one of said at least two loading element's pressure chamber is at a different pressure than a second one of said at least two loading element's pressure chamber.

3. The pressing apparatus of claim 2, wherein said concave pressure surface has at least two pockets displaced in the circumferential direction of said roller and covered by said band, each of said at least two pockets being connected by a throttle duct to a respective one of said pressure chambers of said at least two loading elements.

4. The pressing apparatus of claim 1, wherein said at least two loading elements are displaced in the circumferential direction and disposed symmetrically with respect to the center plane of said pressure shoe.

5. The pressing apparatus of claim 1, wherein said larger radius of curvature of said concave pressure surface is provided over only a portion of said pressure surface.

6. The pressing apparatus of claim 1, wherein said pressure gap formed between said heatable roller and said pressure shoe operates to smooth a paper web.

* * * * *

UNITED STATES PATENT AND TRADEMARK OFFICE

CERTIFICATE OF CORRECTION

PATENT NO. : 5,582,689

DATED : December 10, 1996

INVENTOR(S) : Rolf VAN HAAG and Hans-Rolf CONRAD

It is certified that error appears in the above-indentified patent and that said Letters Patent is hereby corrected as shown below:

Title page, [75], Inventors, change "Hans-Rolf Conard" to --Hans-Rolf Conrad--.

Signed and Sealed this

Tenth Day of June, 1997

Bruce Lehman

*Attest:*

BRUCE LEHMAN

*Attesting Officer*

*Commissioner of Patents and Trademarks*